US011524329B2

(12) United States Patent
Harrop et al.

(10) Patent No.: US 11,524,329 B2
(45) Date of Patent: Dec. 13, 2022

(54) DIE CHANGING APPARATUS

(71) Applicant: Henrob Limited, Flintshire (GB)

(72) Inventors: Kieron Harrop, Wrexham (GB); Philip Williams, Wrexham (GB); Gareth Hill, Liverpool (GB)

(73) Assignee: Atlas Copco IAS UK Limited, Flintshire (GB)

( * ) Notice: Subject to any disclaimer, the term of this patent is extended or adjusted under 35 U.S.C. 154(b) by 492 days.

(21) Appl. No.: 16/623,161

(22) PCT Filed: Jun. 15, 2018

(86) PCT No.: PCT/GB2018/051652

§ 371 (c)(1),
(2) Date: Dec. 16, 2019

(87) PCT Pub. No.: WO2018/229502

PCT Pub. Date: Dec. 20, 2018

(65) Prior Publication Data

US 2021/0053103 A1 Feb. 25, 2021

(30) Foreign Application Priority Data

Jun. 16, 2017 (GB) ..... 1709622

(51) Int. Cl.
*B21J 15/36* (2006.01)
*B21J 15/02* (2006.01)
(Continued)

(52) U.S. Cl.
CPC ..... *B21J 15/36* (2013.01); *B21J 15/025* (2013.01); *B21J 15/14* (2013.01); *B21J 15/30* (2013.01);
(Continued)

(58) Field of Classification Search
CPC . B21J 15/025; B21J 15/14; B21J 15/30; B21J 15/36; Y10T 29/49943; Y10T 29/49956; Y10T 29/5343
See application file for complete search history.

(56) References Cited

U.S. PATENT DOCUMENTS 6,964,094 B2 11/2005 Kondo
7,810,231 B2 10/2010 Naitoh
(Continued)

FOREIGN PATENT DOCUMENTS

CN 201331574 Y 10/2009
CN 203875018 U 10/2014
(Continued)

OTHER PUBLICATIONS

Search Report issued from the United Kingdom Patent Office for related Application No. GB1709622.3 dated Nov. 14, 2017 (3 pages).
(Continued)

*Primary Examiner* — Jermie E Cozart
(74) *Attorney, Agent, or Firm* — Michael Best & Friedrich LLP

(57) ABSTRACT

A die changing apparatus comprises a first die support for supporting a plurality of dies, the die support having first and second die supporting portions which are spaced from one another. The die support is movable so that either the first die supporting portion or the second die supporting portion are locatable at a first transfer position. There is also provided a transfer arrangement comprising a first grip portion configured to grip a die from one of the first and second die supporting portions when said one of the first and second die supporting portions is located at the first transfer position, and thereby remove said gripped die from the first die support. The transfer arrangement is movable, independently of the die support, between a first configuration in
(Continued)

which the first grip portion can grip said die from said one of the first and second die supporting portions when said one of the first and second die supporting portions is located at the first transfer position, and a second configuration in which the first grip portion can release said die and pass it to a second die support of a rivet setter located at a second transfer position.

28 Claims, 8 Drawing Sheets

(51) Int. Cl.
*B21J 15/14* (2006.01)
*B21J 15/30* (2006.01)

(52) U.S. Cl.
CPC .... *Y10T 29/49943* (2015.01); *Y10T 29/49956* (2015.01); *Y10T 29/5343* (2015.01)

(56) References Cited

U.S. PATENT DOCUMENTS 9,162,277 B2 10/2015 Flis et al.
10,058,911 B2 * 8/2018 Ahlemeyer ..... B21J 15/36
2005/0111911 A1 * 5/2005 Zdravkovic ..... B23P 19/062 403/283
2016/0332216 A1 11/2016 Ahlemeyer et al.

FOREIGN PATENT DOCUMENTS

| | | | |
|---|---|---|---|
| CN | 104858282 | A | 8/2015 |
| CN | 106334667 | A | 1/2017 |
| DE | 202013011927 | U1 | 10/2014 |
| EP | 1366836 | A1 | 12/2003 |
| EP | 3093080 | A1 | 11/2016 |
| FR | 891986 | A | 3/1944 |
| WO | 2015/090962 | A1 | 6/2015 |
| WO | 2015/090965 | A1 | 6/2015 |

OTHER PUBLICATIONS

International Search Report with Written Opinion for related Application No. PCT/GB2018/051652 dated Sep. 21, 2018 (10 Pages).
International Preliminary Report on Patentability for related Application No. PCT/GB2018/051652 dated Dec. 17, 2019 (7 Pages).
Chinese Patent Office First Office Action for Application No. 201880051713.7 dated Dec. 29, 2020 (12 pages including English summary).

* cited by examiner

DIE CHANGING APPARATUS

CROSS-REFERENCE TO RELATED APPLICATIONS

This application is a U.S. national stage entry of International Application No. PCT/GB2018/051652, filed Jun. 15, 2018, which claims priority to G.B. Patent Application No. 1709622.3, filed Jun. 16, 2017, the entire contents all of which are hereby incorporated by reference herein.

SUMMARY OF THE INVENTION

The present invention relates to a die changing apparatus, and, in particular, to a die changing apparatus which may form part of a fastening apparatus. The fastening apparatus may be a rivet setter which utilises self-piercing rivets. The invention also relates to associated methods.

There are many known types of fastener which are used to secure two or more portions of a workpiece (for example, two or more sheets) together. One group of such known fasteners functions as follows. A fastener support is placed beneath the workpiece, and a fastener and fastener insertion device are located above both the fastener support and the workpiece. The fastener insertion device applies a force to the fastener to thereby drive the fastener through the workpiece towards the fastener support. In some instances the fastener support may exert a reaction force on the fastener as a result of a force applied to the fastener by the fastener insertion device. The forces acting on the fastener may cause the fastener to deform and thereby secure the two or more portions of the workpiece together.

Examples of such fasteners include rivets, mechanical studs and other types of fastening devices. A particular type of known rivet is the self-piercing rivet. The use of such rivets in conjunction with suitable adhesives or otherwise has become widespread and desirable in industries in which welding is not practical. Such industries include industries which utilise aluminium components. One example of such an industry is the automotive industry in which stacks of metal sheets, including at least one aluminium sheet, may need to be fastened together.

As discussed above, known fastening apparatus includes a fastener support, and a fastener insertion device. The fastener insertion device may include a nose assembly into which a rivet is passed from a rivet storage location, and from which the rivet is inserted into the workpiece by a punch. The fastener support includes an upsetting die which is located beneath the workpiece and which is configured to upset the rivet when the rivet is inserted into the workpiece. The volume and shape of the upsetting die is chosen to provide a desired degree of upsetting such that the rivet adopts a desired shape when it is inserted into the workpiece by the punch.

Feeding apparatus that enables different types of rivet (i.e. rivets having different shapes, dimensions and/or material etc.) to be fed to the nose assembly is already known. When it is desired to fasten different workpieces or different locations on a workpiece which have different fastening requirements (for example, where there is a different number of sheets forming the workpiece/workpiece portion, a different combination of material types and/or different thicknesses of the sheets of the workpiece/workpiece portion, and/or there is a need to use a different type of rivet (as discussed above)), it is frequently necessary to remove the upsetting die and replace it with a different upsetting die which has a different volume and/or shape that is more suited to the different rivet and/or characteristics of the workpiece/workpiece portion concerned. Furthermore, dies are consumable items—eventually they wear so that they can no longer provide the required degree of upsetting such that the rivet adopts a required shape. This may result in unsatisfactory joints. A die that has worn out must be replaced.

Die changers for removing and replacing dies of a fastening apparatus are already known. Such die changers can be relatively inefficient to use. Anything that can be done to improve the efficiency of the die changers, and thereby reduce maintenance downtime and/or latent periods during the operation of the fastening apparatus will be advantageous.

In addition, known fastening apparatus and die changers are often located in restricted areas—that is areas to which access by personnel is restricted for safety reasons. In such situations it is common that all the machinery within the restricted area must be powered down before personnel can enter. This makes accessing the die changer difficult and hence removing unwanted dies from and replenishing new dies to the die changer problematic.

It is desirable to provide an apparatus and method which mitigates at least one of the problems associated with known die changers, whether discussed herein or not.

According to the first aspect of the invention there is provided a die changing apparatus comprising a first die support for supporting a plurality of dies, the first die support having first and second die supporting portions which are spaced from one another, the die support being movable so that either the first die supporting portion or the second die supporting portion are locatable at a first transfer position; a transfer arrangement comprising a first grip portion configured to grip a die from one of the first and second die supporting portions when said one of the first and second die supporting portions is located at the first transfer position, and thereby remove said gripped die from the first die support; the transfer arrangement being movable, independently of the first die support, between a first configuration in which the first grip portion can grip said die from said one of the first and second die supporting portions when said one of the first and second die supporting portions is located at the first transfer position, and a second configuration in which the first grip portion can release said die and pass it to a second die support of a rivet setter located at a second transfer position.

The ability to independently move the first die support and the transfer arrangement means that there is more freedom regarding movement of the first die support. For example, if the first die support is a carousel, it is possible to rotate the carousel either clockwise or anti-clockwise—this enables the correct die supporting portion to be positioned as quickly as possible, hence reducing any latent periods during operation of the fastening apparatus. Furthermore, the use of a separate transfer arrangement means that as soon as the transfer arrangement has removed a selected die from a die supporting portion, the first die support can be moved to prefetch the next die if it is at a different die supporting portion. Again, this can reduce any latent periods during operation of the fastening apparatus Movement of the transfer arrangement between the first configuration and the second configuration may be a rotation about an axis. The amount of rotation of the transfer arrangement between the first configuration and the second configuration may be 180°, or any other appropriate amount.

The first die support may be a carousel which is rotatable about a first axis. The first and second die supporting portions may be angularly spaced from one another about the first axis. The first die support may be rotatable so that either the first die supporting portion or the second die supporting portion are locatable at a first transfer position.

The transfer arrangement may comprise a second grip portion, and in the first configuration of the transfer arrangement the second grip portion may be configured to grip a second die from the second die support of the rivet setter located at the second transfer position, and in the second configuration of the transfer arrangement the second grip portion may release said second die and pass it to a disposal target.

Use of a second grip portion means it is possible to simultaneously remove two separate dies—one from the rivet setter (e.g. second die support) and one from the first support portion (e.g. first die support); and, subsequently, simultaneously release said separate dies—one to the disposal target and one to the rivet setter (e.g. second die support). This simultaneous operation results in improved speed of operation as compared to carrying out the relevant actions one after another.

The disposal target may form part of the first die support.

The disposal target may be one of: the first die supporting portion, the second die supporting portion or a third die supporting portion.

The disposal target of the first die support may be a waste receptacle or conduit.

The first die support may comprise a waste receptacle or conduit. The transfer arrangement may be configured to remove a second die from the second die support of the rivet setter and pass it to the waste receptacle or conduit when the waste receptacle or conduit is located at the first transfer position.

The first die support may comprise a waste conduit. The waste conduit may have a first end connected to the first die support and a second end spaced from the first end. The die changing apparatus may be configured whereby when the first die support is located such that the waste conduit is located at the first transfer position, the second end of the waste conduit is located adjacent a second waste receptacle or conduit, such that if said second die is passed to the waste conduit, the second die may pass through the waste conduit from the first end to the second end, and then into the second waste receptacle or conduit.

A portion of the die changing apparatus may be configured to be located within a restricted area, into which entry by personnel is restricted. The die changing apparatus may comprise a second waste conduit. The first transfer position may be located in the restricted area and the second waste conduit may comprise third and fourth spaced ends. The third end may be located adjacent the waste conduit when the second end of the waste conduit is located adjacent the second waste conduit. The fourth end may be located outside of the restricted area.

This prevents an operator from having to enter a restricted area to remove a waste die removed from the rivet setter.

A portion of the die changing apparatus may be configured to be located within a restricted area, into which entry by personnel is restricted, such that the first transfer position is located in the restricted area. A portion of the first die support may be locatable outside the restricted area, said portion of the first die support comprising the disposal target or the waste receptacle.

Again, this prevents an operator from having to enter a restricted area to remove a waste die removed from the rivet setter.

The first waste receptacle or second waste receptacle may be configured to contain a plurality of received dies. The first waste receptacle or second waste receptacle may support said plurality of received dies next to one another in the same order to that in which the dies are received.

This enables post-analysis of the waste dies—because their characteristics can be analysed based on the chronology of when they were removed from the rivet setter.

A portion of the die changing apparatus may be configured to be located within a restricted area, into which entry by personnel is restricted, such that the first transfer position may be located in the restricted area. A portion of the first die support may be locatable outside the restricted area, said portion of the first die support comprising the first and/or second die supporting portion.

This prevents an operator from having to enter a restricted area to replenish/replace any of the dies supported by the first and/or second die supporting portions.

Each of the first die supporting portion and the second die supporting portion may be configured to support a plurality of dies. The first die supporting portion may be configured to support a plurality of dies of a first type and the second die supporting portion may be configured to support a plurality of dies of a second type.

According to a second aspect of the invention there is provided a method of changing a die using a die changing apparatus, the die changing apparatus comprising: a first die support, the first die support having first and second die supporting portions which are spaced from one another, and a transfer arrangement comprising a first grip portion, the method comprising: supporting a plurality of dies on the first die support, moving the first die support so that either the first die supporting portion or the second die supporting portion are located at a first transfer position; the first grip portion gripping a die from one of the first and second die supporting portions when said one of the first and second die supporting portions is located at the first transfer position, and the transfer arrangement thereby removing said gripped die from the first die support; moving the transfer arrangement, independently of the first die support, between a first configuration in which said gripping can occur, and a second configuration in which the first grip portion releases said die and passes said die to a second die support of a rivet setter located at a second transfer position.

The first die support may be a carousel which is rotatable about a first axis. The first and second die supporting portions may be angularly spaced from one another about the first axis. Said moving the first die support so that either the first die supporting portion or the second die supporting portion are located at a first transfer position may comprise the first die support being rotated so that either the first die supporting portion or the second die supporting portion are at a first transfer position.

The transfer arrangement may comprise a second grip portion. In the first configuration of the transfer arrangement the second grip portion may grip a second die from the second die support of a rivet setter located at the second transfer position. In the second configuration of the transfer arrangement the second grip portion may release said second die and pass it to a disposal target.

The disposal target may forms part of the first die support.

The disposal target may be one of: the first die supporting portion, the second die supporting portion or a third die supporting portion.

The disposal target of the first die support may be a waste receptacle or conduit.

The first die support may comprise a waste receptacle or conduit. The method may further comprise: the transfer arrangement removing a second die from the second die support of a rivet setter and passing it to the waste receptacle or conduit when the waste receptacle or conduit is located at the first transfer position.

The first die support may comprise a waste conduit. The waste conduit may have a first end connected to the first die support and a second end spaced from the first end. The method may further comprise: locating the first die support such that the waste conduit is located at the first transfer position, locating the second end of the waste conduit adjacent a second waste receptacle or conduit, passing the second die to the waste conduit, such that the second die passes through the waste conduit from the first end to the second end, and then into the second waste receptacle or conduit.

A portion of the die changing apparatus may be located within a restricted area, into which entry by personnel is restricted. The die changing apparatus may comprise a second waste conduit. The first transfer position may be located in the restricted area and the second waste conduit may comprise third and fourth spaced ends. The method may further comprise: locating the third end adjacent the waste conduit when the second end of the waste conduit is located adjacent the second waste conduit; and locating the fourth end outside of the restricted area.

A portion of the die changing apparatus may be located within a restricted area, into which entry by personnel is restricted, such that the first transfer position may be located in the restricted area; the method may comprise locating a portion of the first die support outside the restricted area, said portion of the first die support comprising the disposal target or the waste receptacle.

The first waste receptacle or second waste receptacle may receive a plurality of dies. The method may further comprise: the first waste receptacle or second waste receptacle supporting said plurality of received dies next to one another in the same order to that in which the dies are received.

A portion of the die changing apparatus may be located within a restricted area, into which entry by personnel is restricted, such that the first transfer position may be located in the restricted area; wherein the method may further comprise locating a portion of the first die support outside the restricted area, said portion of the first die support comprising the first and/or second die supporting portion.

Each of the first die supporting portion and the second die supporting portion may support a plurality of dies. The first die supporting portion may support a plurality of dies of a first type and the second die supporting portion may support a plurality of dies of a second type.

According to a third aspect of the invention there is provided a method of manufacturing a product, the method comprising fastening together two or more layers of a workpiece using a rivet setter in combination with a die changing apparatus which carries out a method according to the previous aspect of the invention.

The product may be a vehicle.

It will be appreciated that, where appropriate, any of the optional features discussed above in relation to one of the aspects of the invention, may equally be applied to any of the other aspects of the invention.

BRIEF DESCRIPTION OF THE DRAWINGS

Specific embodiments of the present invention will now be described, by way of example only, with reference to the accompanying drawings in which.

DETAILED DESCRIPTION

It will be appreciated that, although, for the sake of simplicity, the present invention is described in relation to a die changer for dies of a self-piercing rivet setter, the invention is equally applicable to any fastening apparatus in which the fastener support includes a portion which must be regularly changed. The regularly changed portions may be changed by a die changer or method according to the invention.

Figure 1:
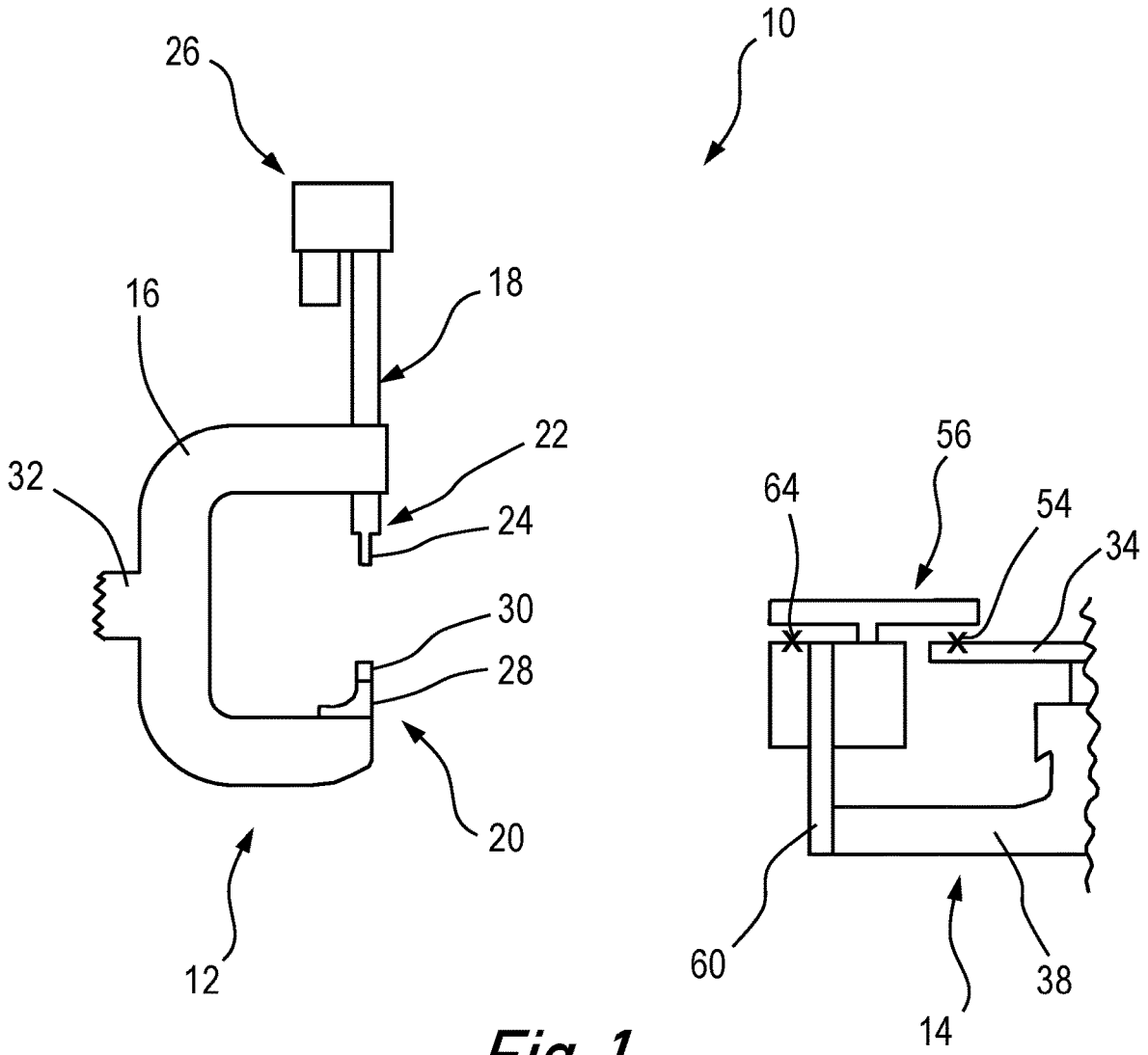
FIG. 1 shows a schematic view of a fastening apparatus according to an embodiment of the invention.

FIG. 1 shows a schematic view of a portion of a fastening apparatus 10 according to an aspect of the present invention. The fastening apparatus 10 includes a rivet setter 12 and a die changer 14. The rivet setter 12 comprises a C-clamp 16 having a first end at which a fastener insertion device 18 is mounted, and a second end at which a fastener support 20 is mounted, such that the fastener insertion device 18 and fastener support 20 oppose one another. The fastener insertion device includes a nose assembly 22 into which a rivet is passed from a rivet storage location (not shown). The nose assembly further includes a punch 24. An actuator 26 is used to, in use, move the punch 24 towards the fastener support 20 and any workpiece which is located between the fastener insertion device 18 and fastener support 20.

The fastener support 20 includes a die support 28 which supports a die 30.

The rivet setter 12 may be mounted via a mounting portion 32 to any appropriate device for positioning the rivet setter. For example, in some applications, the rivet setter may be mounted to a robotic arm.

In use, the rivet setter 12 is moved to an appropriate location such that a workpiece to be riveted is located between the fastener insertion device 18 and fastener support 20. The actuator 26 moves a portion of the nose assembly 22 closer to the workpiece. A rivet is supplied to the nose assembly 22 and the actuator 26 drives the punch 24 so that the rivet is inserted into the workpiece by the punch 24. The rivet is driven into the workpiece and a reaction force is exerted on the rivet by the die 30 which contacts the workpiece. The reaction force exerted by the die 30 causes the rivet which has been driven into the workpiece to be upset, thereby causing the rivet to deform and the workpiece to be riveted (i.e. secured together by the rivet).

The apparatus and method outlined above in order to insert a rivet into a workpiece is already well known and is not a key aspect of the present invention. As such, for the sake of brevity, further description as to the operation of a rivet setter when inserting a rivet into a workpiece is omitted.

As previously discussed, the fastening apparatus 10 also includes a die changer 14. The die changer is discussed in more detail below. The die changer 14 (which may also be referred to as a die changing apparatus) is shown in more detail in FIGS. 2 and 3.

The die changer 14 includes a first die support 34 for supporting a plurality of dies. In the present embodiment, and as shown most clearly in FIG. 5, the first die support 34 takes the form of a carousel which is rotatable about a first Axis A. In the particular embodiment shown the first die support 34 is driven for rotation by actuator 36. The actuator 36 and first die support 34 are mounted to a support arm 38.

Figure 3:
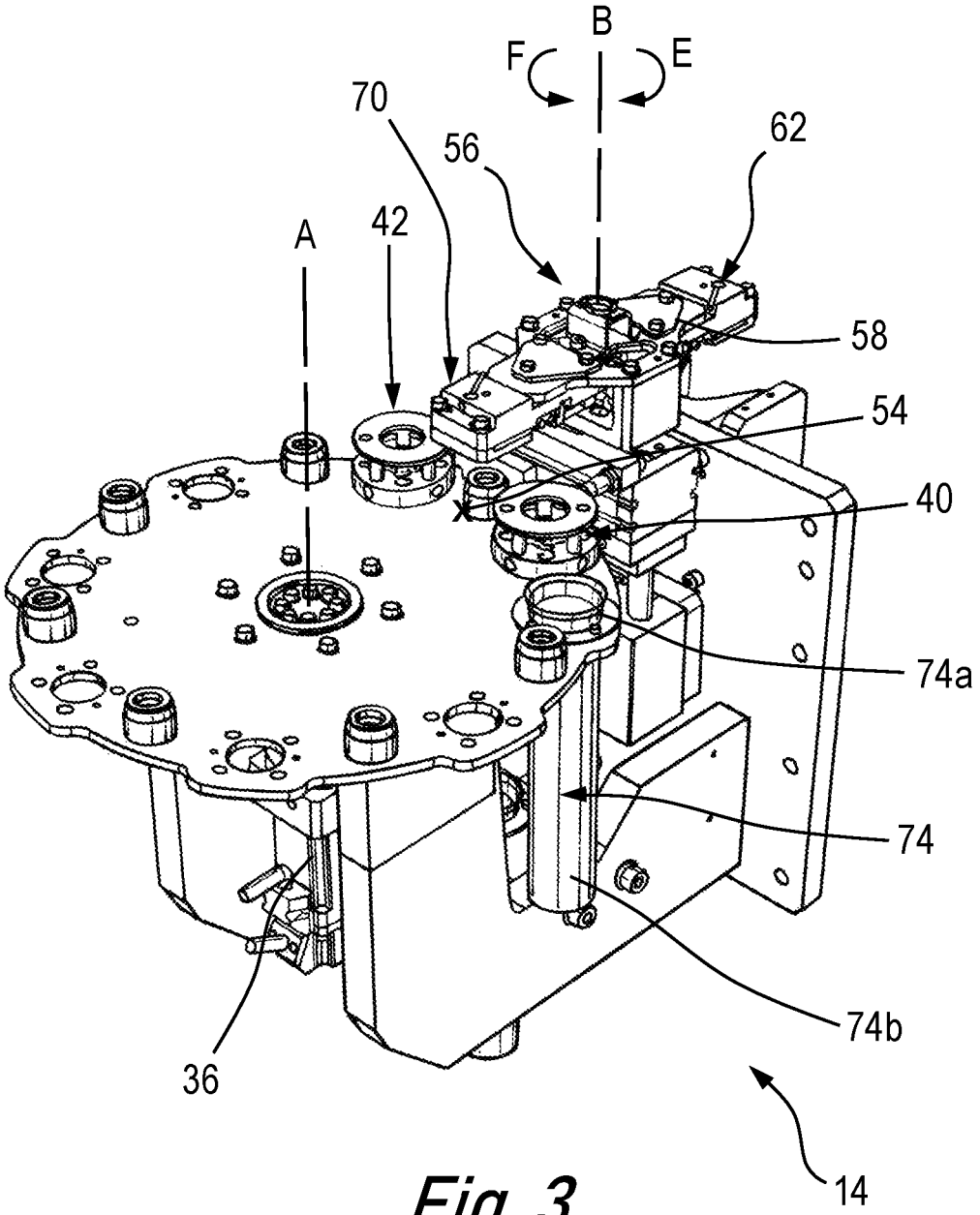
FIG. 3 shows another view of the die changer shown in FIG. 2, in which the transfer arrangement is in a second configuration.

The first die support 34 has first and second die supporting portions 40, 42 (as shown in FIG. 3) which are spaced from one another.

In the presently shown embodiment, the first and second die supporting portions 40, 42 each take the form of a die cartridge. As seen best in FIG. 5, each die cartridge 44 includes a cartridge support 46 which is secured to a main body 49 of the carousel first die support 34. The cartridge 44 also includes a main body 48 which is secured to the cartridge support 46 and thereby forms part of the first die support 34.

The exact structure and method of operation of the die cartridge 44 is discussed in a co-filed UK patent application filed by the present applicant on the same date of filing as the present application. The structure and method of operation of the cartridge 44 is not key to the present invention. Consequently, for the sake of brevity, further discussion of the structure and operation of the cartridge is omitted. Within those jurisdictions within which it is permitted, the contents of the aforementioned co-filed UK application relating to the structure and method of operation of the cartridge is hereby incorporated by reference.

Despite what is said above, one aspect of the die cartridges 44 which is worthy of mention is that they are configured to support a plurality (for example 5 or 6) of dies. In some embodiments the first and second die supporting portions 40, 42 in the form of first and second cartridges may support dies of the same type. In other embodiments the first and second die supporting portions in the form of first and second die cartridges may support different types of die—that is to say, the first die supporting portion may support a plurality of dies of a first type, and the second die supporting portion may support a plurality of dies of a second type.

Figure 4:
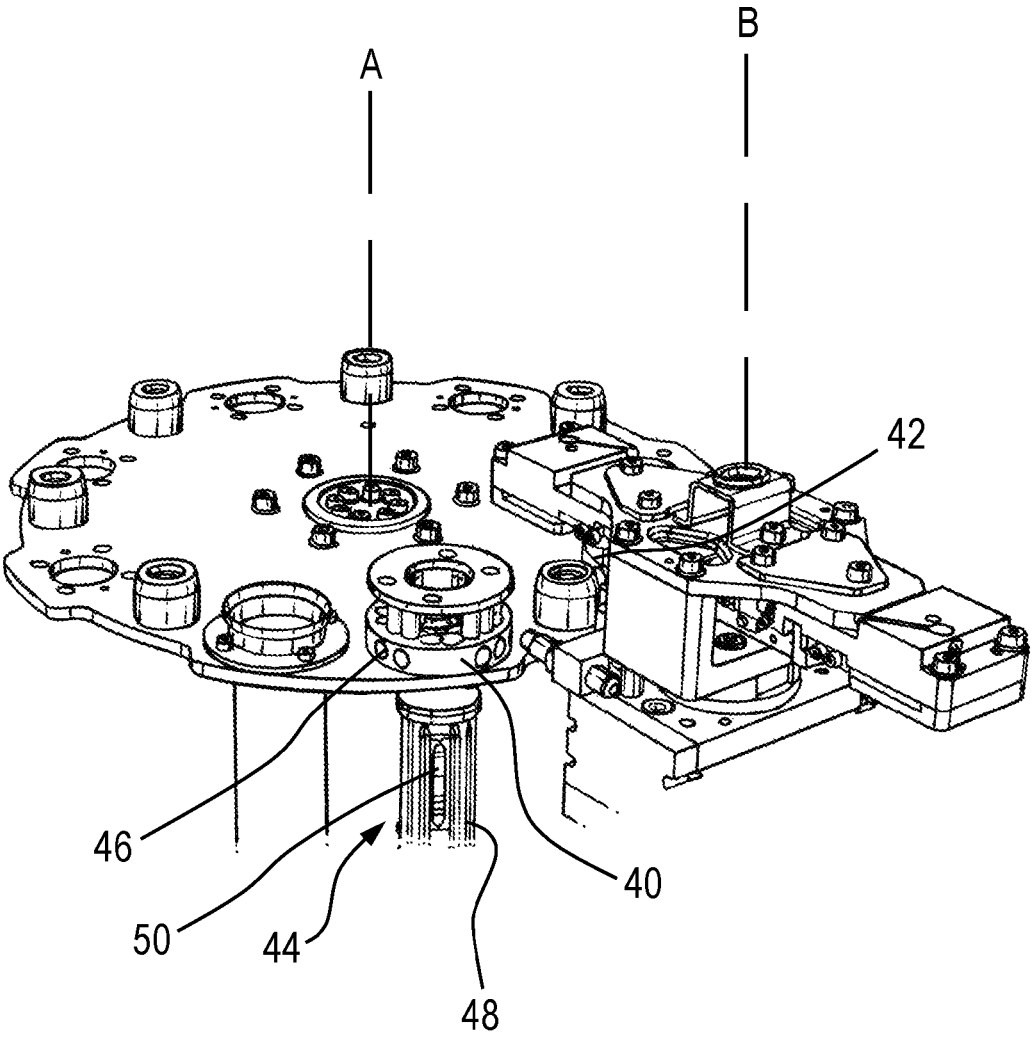
FIGS. 4 and 5 show views of portions of the die changer shown in FIG. 2.
Figure 5:
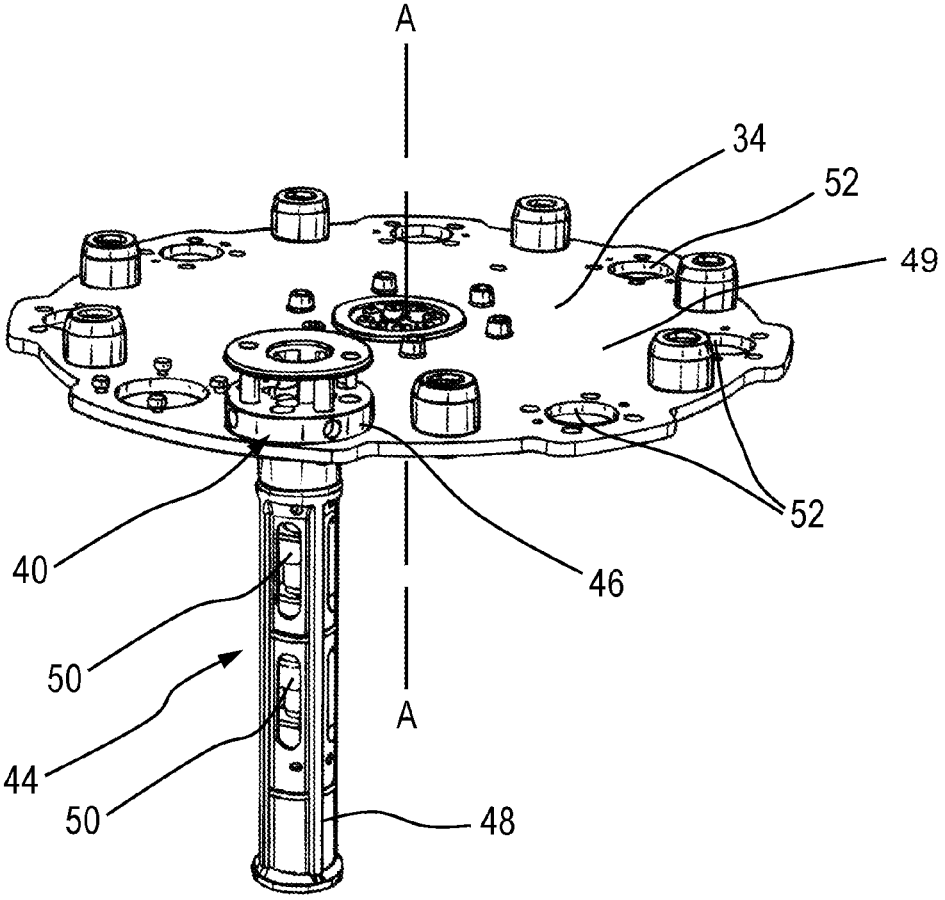

It is also worth noting that, for the purpose of increasing the clarity of the figures, the first die supporting portion 40 and second die supporting portion 42 are not shown, at all or in their entirety, within some of the figures. In more detail, within FIG. 2, only the cartridge support for a first die supporting portion in the form of a cartridge is shown. FIG. 3 shows cartridge support for both the first and second die supporting portions, 40, 42. FIG. 4 shows the cartridge supporting portion 46 and main body 48 of the cartridge for the first die supporting portion 40, whereas only the cartridge support of the second die supporting portion is visible. Finally, FIG. 5 shows only the first die supporting portion 40 in the form of the cartridge 44 including both the cartridge support 46 and cartridge main body 48.

It will be appreciated that the figures only show two die supporting portions. It is within the scope of the present invention for there to be any number greater than one of die supporting portions. For example, as can be seen clearly in FIG. 5, the carousel first die support 34 includes several additional spaces (for example those indicated by reference numeral 52) which could each serve as a location for a further die supporting portion.

Furthermore, the design of the first die support shown in the figures should not be taken to be limiting—for example, the carousel first support portion may have any appropriate number greater than one number of locations on it for die supporting portions.

In addition, although the die supporting portions shown within the figures of the present document are cartridges which hold a plurality of dies, any appropriate die supporting portion may be used. Such a die supporting portion may include one or more dies. In addition, in embodiments in which a plurality of dies are supported by each die supporting portion, the plurality of dies supported by each die supporting portion need not be the same.

As previously discussed, the first and second die supporting portions 40, 42 are spaced from one another. In particular, in the present embodiment, the first and second die supporting portions are angularly spaced from one another about the first axis A.

The die support 34 is movable so that either the first die supporting portion 40 or second die supporting portion 42 are locatable at a first transfer position 54. The nature of the first transfer position 54 is discussed in more detail at a later point within this document. In the particular embodiment shown, the die support 34 is rotatable in either direction in order to locate the first or second die supporting portion at the first transfer position 54.

The fact that the first die support 34 of the die changer 14 is rotatable in either direction is advantageous over any such system which is only movable/rotatable in a single direction because it ensures that when it is necessary to rotate the first die support so as to change the die supporting portion (or waste receptacle/conduit—see later) located at the first transfer position, the quickest direction of rotation (clockwise or anticlockwise) between the current die supporting portion located at the first transfer position and the die supporting portion it is intended to locate at the first transfer position can be used.

The die changer 14 also includes a transfer arrangement 56. In the present embodiment the transfer arrangement 56 takes the form of an arm 58 which is both translatable and rotatable about a second axis B. The transfer arrangement 56 and its actuator are mounted to a base plate 60 from which the arm 38 supporting the first die support 34 depends.

The transfer arrangement 56 comprises a first grip portion indicated generally by reference numeral 62. The specifics of operation of the first grip portion (and second grip portion, described later) is not key to the present invention. Any appropriate arrangement may be used as a grip portion according to the present invention provided it is capable of being placed adjacent to or around a die and then actuated so as to exert a force on the die so as to secure it to the transfer arrangement and then, later, be de-actuated so as to release the die from the transfer arrangement. Suitable examples include a grip portion including a grip member which extends to contact the die or an electromagnet which can be actuated so as to magnetically retain the die. In light of the fact that any suitable grip portion may be used, and given the subsidiary nature of the importance of the operation of this feature as part of the present invention, further description of this point is omitted for the sake of brevity.

The first grip portion is configured to grip a die from one of the first and second die supporting portions when one of the first and second die supporting portions 40, 42 is located at the first transfer position 54, and thereby remove said gripped die from the first die support. In the present embodiment this is achieved as follows, with reference to FIG. 2. The die supporting portion from which a die is to be extracted by the transfer arrangement is located at the first transfer position. This is achieved by moving the first die support 34, which, in the present case, is movement by rotation. The first transfer position is a position vertically below (with respect to the orientation of the apparatus shown in FIG. 2) the first grip portion 62. In the embodiment shown in FIG. 2, the die supporting portion which is located at the first transfer position 54 is the second die supporting portion 42. Once the relevant die supporting portion has been located at the first transfer position 54, the transfer arrangement 56 (and therefore arm 58 and first grip portion 60) are translated along axis B in the direction C by the actuator of the transfer arrangement 56. The transfer arrangement moves in the direction C until it contacts the second die supporting portion 42. As is discussed in more detail in the co-filed application relating to the cartridge, contacting the second die supporting portion causes a die to be released from the second cartridge which constitutes the second die supporting portion 42. Further details regarding the operation of the cartridge are not of importance to the invention and, consequently, for the sake of brevity, are not discussed in any more detail here. Once the die has been released from the second die supporting portion 42 it is received by the first grip portion 62 of the transfer arrangement 56. The first grip portion 62 is then actuated so as to grip the die. The actuator of the transfer arrangement 56 then actuates the transfer arrangement 56 so as to move it along the axis B in the direction D away from the first die support 34. In this way the gripped die is removed from the second die supporting portion 42 and hence the first die support 34.

Figure 2:
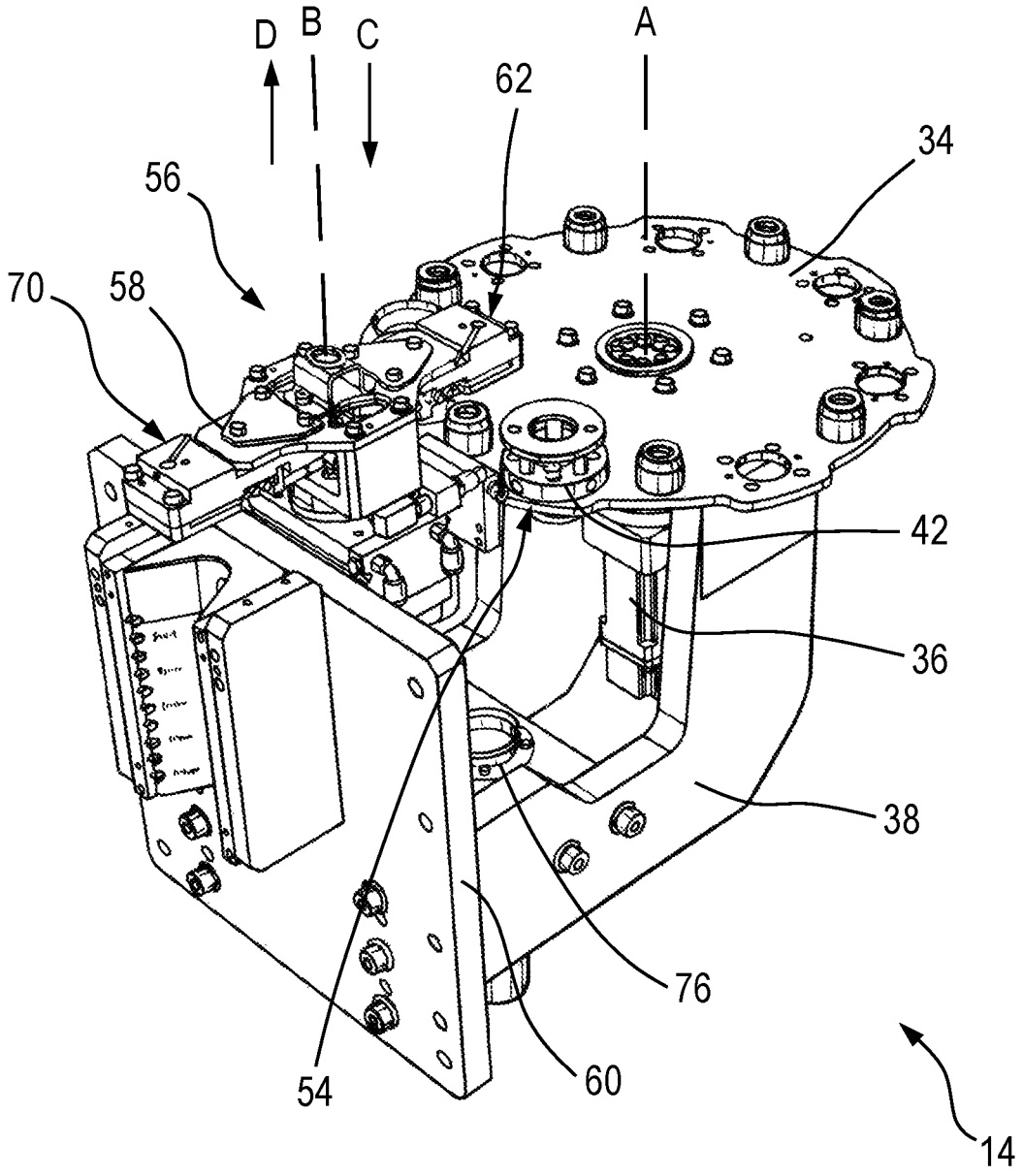
FIG. 2 shows a view of a die changer according to an embodiment of the invention, in which a transfer arrangement is in a first configuration.

The transfer arrangement 56 is movable, independently of the die support 34, between a first configuration (as shown in FIG. 2) in which the first grip portion 62 can grip the relevant die from the relevant die supporting portion in the manner discussed above (i.e. by moving the transfer arrangement 56 in the direction C and the actuating the first grip portion 62), and a second configuration (as shown in FIG. 3) in which the first grip portion can release said die and pass it to a second die support 28 of a rivet setter 12 located at a second transfer position 64.

By comparing FIGS. 2 and 3 it can be seen that the movement of the transfer arrangement between the first configuration shown in FIG. 2 and the second configuration shown in FIG. 3 constitutes a rotation of the transfer arrangement 56 about axis B by 180 degrees. Such rotation is carried out by the transfer arrangement actuator. The rotation may occur in either a clockwise direction E or an anti-clockwise direction F, as is most appropriate. It will be appreciated that it is within the scope of the invention that the rotation of the transfer arrangement 56 between the first configuration and the second configuration may be any appropriate amount of rotation, for example, but not limited to 30°, 45°, 60°, 90°, 120°, 135°, 150° and 180°. The amount of rotation of the transfer arrangement 56 from the first configuration to the second configuration and then from the second configuration to the first configuration may be 360°. In some embodiments the amount of rotation from the first configuration to the second configuration may be the same as the amount of rotation from the second configuration to the first configuration. In other embodiments this need not be the case. Furthermore, it will be appreciated that the transfer arrangement may have any appropriate shape or structure provided it is configured to rotate between the first configuration and the second configuration.

Figure 6:
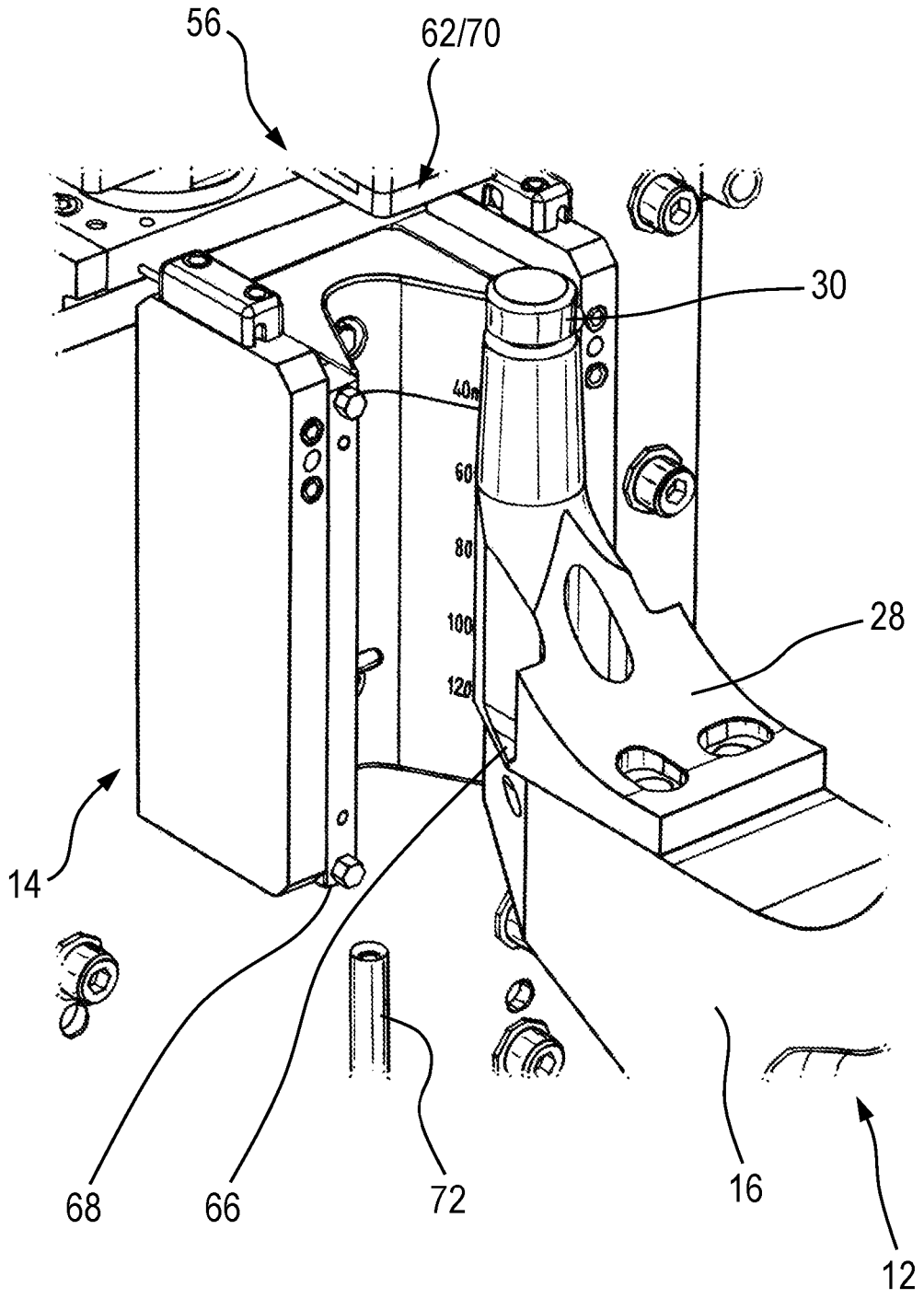
FIG. 6 shows a view of a portion of the die changer shown in FIG. 2 in combination with a portion of a rivet setter.

In the present embodiment the second transfer position is best understood with reference to FIG. 6. FIG. 6 shows a portion of the rivet setter 12 and a portion of the die changer 14. The die support 28 of the rivet setter 12 supports a die 30. As will be appreciated, in order for the die support 28 to receive a further die, the die 30 must be removed. Die 30 may be removed in any appropriate manner. A specific manner according to the present invention is discussed at a later point within the present document. For the sake of discussing the second configuration of the transfer arrangement 56 in which the first grip portion 62 can release a die and pass it to the second die support 28 of a rivet setter located at a second transfer position, we should assume that the die 30 within FIG. 6 has already been removed. The second transfer position at which the second die support 28 of the rivet setter 12 is located is the position of the die support 28 when the rivet setter 12 is moved relative to the die changer 14 such that a shoulder 66 of the rivet setter 12 abuts a hard stop of the die changer 14 in the form of surface 68. With the rivet setter 12 located relative to the die changer 14 such that the die support 28 is located at the second transfer position 64 the die support 28 is located vertically below (given the orientation of the Figures) the first grip portion 62 when the transfer arrangement 56 is in the second configuration (as shown in FIG. 3).

In order to pass the die gripped by the first grip portion 62 of the transfer arrangement 56 to the second die support 28 the actuator of the transfer arrangement 56 actuates the transfer arrangement 56 so as to move it along axis B in the direction C. The gripped die is thereby located in the second die support 28 and the first grip portion 62 can be de-actuated so that it releases the die and leaves it in the second die support 28. With the die located in the second die support 28 a die retention mechanism within the second die support can be actuated to retain the die within the second die support. Then, if required, the actuator of the transfer arrangement 56 can be actuated so as to move the transfer arrangement 56 along the axis B in the direction D so as to return the transfer arrangement 56 to its original position.

In the present embodiment the transfer arrangement 56 comprises a second grip portion 70 located at the opposite end of the arm 58 of the transfer arrangement 56 as compared to the first grip portion 62.

Other than their location at opposite ends of the arm of the transfer arrangement, the first and second grip portions are substantially identical and operate in a substantially identical manner. In the first configuration of the transfer arrangement 56, as shown in FIG. 2 (and in FIG. 6 provided that the portion of the transfer arrangement visible within the figure is the second grip portion 70), the second grip portion 70 can grip a second die 30 from the second die support 28 of the rivet setter 12 when the rivet setter is located at the second transfer position. This is achieved as follows: when the transfer arrangement 56 is in the first configuration the actuator of the transfer arrangement 56 can actuate the transfer arrangement 56 so as to move it along the axis B in the direction C such that the second grip portion 70 is located adjacent to or around the second die 30. The second grip portion can then be actuated so as to cause it to exert a force on the second die and thereby secure the second die to the second grip portion. The transfer arrangement 56 can then be actuated by the actuator of the transfer arrangement so as to move the transfer arrangement along the axis B in the direction D. This removes the second die 30 from the second die support 28.

Before the second die 30 is to be removed, whilst the rivet setter is operating to insert rivets into a workpiece, the second die 30 is secured to the second die support 28. This is achieved by a die retention mechanism that is of a known type. Due to the fact that the die retention mechanism is known and its operation is not key to the carrying out of the invention, for the sake of brevity, its operation is not discussed in any further detail. That said, given that the second die 30 is normally secured to the second die support, it will be clear that before the second die 30 is removed from the second die support 28 the die retention mechanism has to be released. In the present embodiment this is achieved as follows. FIG. 6 shows a die removal pin 72. The die removal pin 72 is located beneath the second transfer position. When the rivet setter is located at the second transfer position, the die removal pin 72 is moved vertically upwards through an aperture (not shown) in the underside of the C-frame. The die removal pin 72 passes through the aperture into the second die support 28, where it causes the die retention mechanism to release and the die to move slightly upwards. Once the die retention mechanism has been released and the die has moved upwards the die can be gripped by the second grip portion 70 and removed from the second die support.

It will be appreciated that this portion of operation of the transfer arrangement (whereby the die can be gripped by the second grip portion 70 and removed from the second die support) can occur simultaneously to when the first grip portion grips a die from the first or second die supporting portion, as discussed above. Consequently, provided that the first or second die supporting portion is located at the first transfer position, and the second die support of the rivet setter is located at the second transfer position simultaneously, then the first grip portion 62 of the transfer arrangement 56 can grip the die to be removed from the first or second die supporting portion at the same time that the second grip portion 70 can grip the die 30 to be removed from the second die support 28.

Once the die 30 has been removed from the second die support 28 the transfer arrangement 56 can be moved to the second configuration. In the second configuration of the transfer arrangement 56 the second grip portion 70 is de-actuated so as to release the second die 30 and pass it to a disposal target. The disposal target may be located at the first transfer position.

Again, it will be appreciated that this portion of operation of the transfer arrangement can occur simultaneously to when the first grip portion 62 releases the die and passes it to the second die support 28 of the rivet setter 12 located at a second transfer position 64, as discussed above. Consequently, provided that the disposal target is located at the first transfer position, and the second die support of the rivet setter is located at the second transfer position simultaneously, the first grip portion 62 can release the die and pass it to the second die support 28 of the rivet setter 12 at the same time that the second grip portion 70 can release the die 30 and pass it to the disposal target.

Depending on the application, the disposal target may be any appropriate entity to which it is desired to pass used dies. In some embodiments the disposal target may be separate to the first die support. However, in the present embodiment, the disposal target forms part of the first die support 34 and the disposal target is a waste conduit 74. The waste conduit 74 is secured to the first die support 34 in one of the additional spaces 52 of the carousel. The waste conduit 74 extends generally vertically downwards and is sized so that a die can pass through it. In more detail, the waste conduit has a first end 74*a* connected to the first die support 34 and a second end 74*b* spaced from the first end 74*a*. The first die support 34 is located such that when the first end 74*a* of the waste conduit 74 is located at the first transfer position 54, the second end 74*b* of the waste conduit 74 is located adjacent a second waste conduit 76, as seen best in FIG. 2, such that if the second die is passed to the waste conduit 74, the second die will pass (via the action of gravity) through the waste conduit 74 from the first end 74*a* to the second end 74*b*, and then into the second waste conduit 76. In other embodiments the second waste conduit may be replaced with or additionally include a second waste receptacle. When the first end of the waste conduit is located at the first transfer position, the second end of the waste conduit is located adjacent the second waste receptacle such that if the second die is passed to the waste conduit, the second die will pass (via the action of gravity) through the waste conduit from the first end to the second end, and then into the second waste receptacle.

The first waste conduit is connected to the first die support such that it moves therewith, whereas the second waste conduit or second waste receptacle is separate to the first die support such that it does not move with the first die support.

In some embodiments the first waste conduit 74 may be replaced by a waste receptacle. The difference between a waste conduit and a waste receptacle is that a waste conduit is designed to carry waste (e.g. waste dies) from one location to another, whereas a waste receptacle is designed to store or contain the waste, before the waste is emptied as part of a maintenance operation.

So far the disposal targets discussed have been those where it is desired to treat the die removed from the rivet setter as waste. This may be the case if the die has carried out so many riveting operations such that it is worn out. In other applications the die removed from the rivet setter may not be fully worn and may therefore not be waste. In such instances it may be desirable for the die to be placed in a die supporting portion so that it can be reused at a later point. To that end the disposal target may be one of: the first die supporting portion, the second die supporting portion or a third die supporting portion.

In some applications of fastening apparatus the fastening apparatus is located in a restricted area, to which access by personnel is restricted for safety reasons. In such situations it is common that all the machinery within the restricted area must be powered down before personnel can enter. In one example, the rivet setter may be located on the end of a robotic arm. Because the rivet setter is located at the end of a robotic arm, the rivet setter presents a safety risk—the robotic arm may inadvertently move the rivet setter, thereby causing injury. For this reason, in this instance, the rivet setter is located in a restricted area. Due to the fact that the rivet setter must access the die changer, at least a portion of the die changer must also be located in the restricted area.

In some embodiments, the first transfer position 54 is located in the restricted area R and the second waste conduit 76 comprises third 76*a* and fourth 76*b* spaced ends, the third end 76*a* being located adjacent the waste conduit 74 when the second end 74*b* of the waste conduit 74 is located adjacent the second waste conduit 76, and the fourth end 76*b* is located outside of the restricted area (also referred to the unrestricted area U). In this way the first and second waste conduits can convey any die removed from the rivet setter to a location outside of the restricted area. In this way it is not necessary for an operator to enter the restricted area in order to remove waste dies. As such, removing waste dies does not result in downtime for the fastening apparatus.

In some embodiments the first transfer position 54 is located in the restricted area R; and a portion of the first die support 34 is locatable outside the restricted area (in unrestricted area U), said portion of the first die support comprising the disposal target or the waste receptacle. In this way, by moving the first die support, it is possible to locate the disposal target or the waste receptacle outside the restricted area. Being able to move the disposal target or the waste receptacle so that they are outside of the restricted area means that any of the dies removed from the rivet setter can easily be removed from the fastening apparatus without the need to access the restricted area and therefore shut down the machinery in the restricted area.

Figure 8:
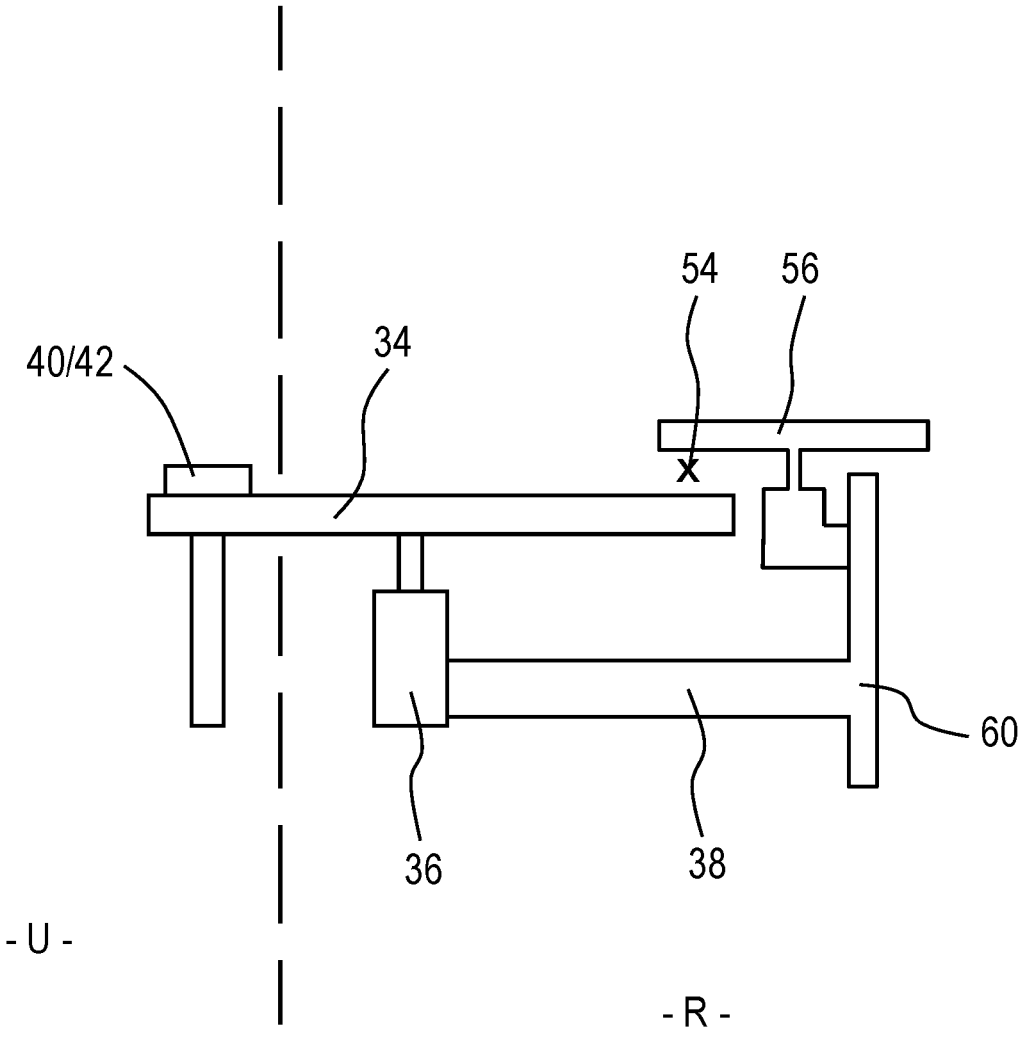
FIG. 8 shows a schematic view of a die changer according to a further embodiment of the invention.

In some embodiments, like that shown in FIG. 8, the first transfer position 54 is located in the restricted area R. A portion of the first die support 34 is locatable outside the restricted area (in the unrestricted area U), said portion of the first die support comprising the first and/or second die supporting portion 40, 42. In this way, by moving the first die support, it is possible to locate the first and/or second die supporting portion outside the restricted area. Being able to move the first and/or second die supporting portions so that they are outside of the restricted area means that any die support portion which runs out of relevant dies can be replenished without the need to access the restricted area and therefore the need to shut down the machinery in the restricted area.

Figure 7:
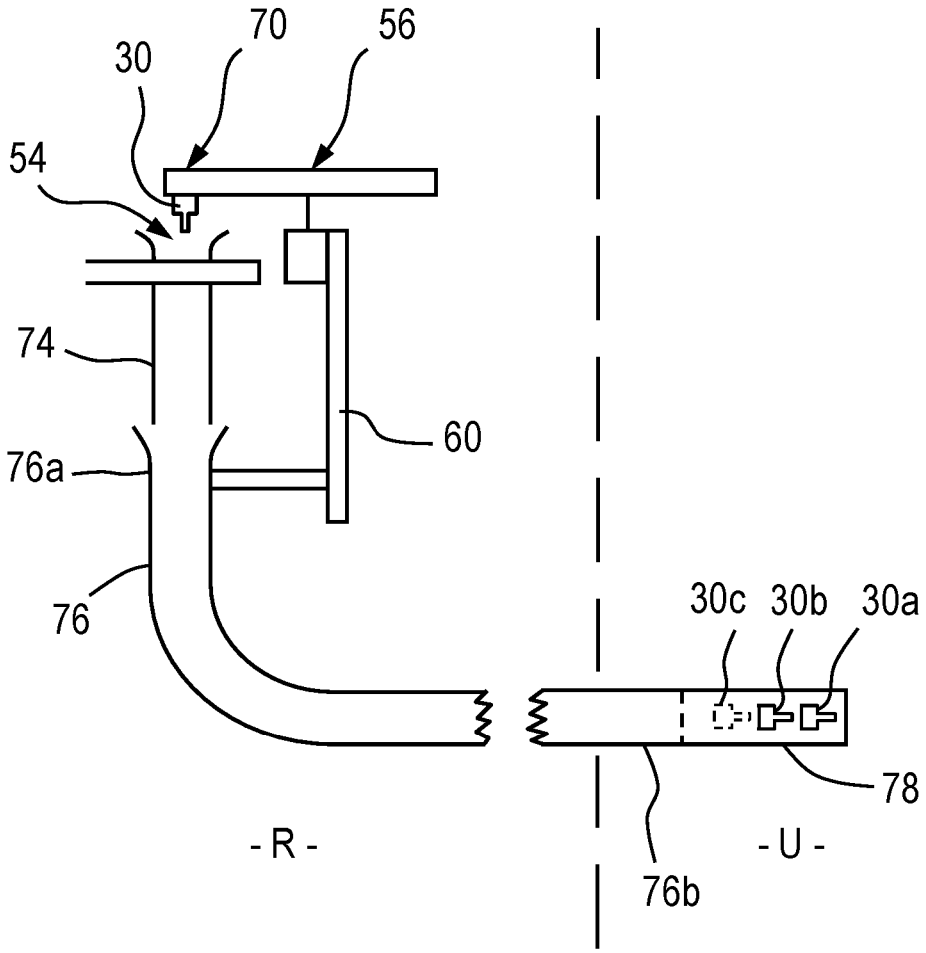
FIG. 7 shows a schematic view of a die changer according to another embodiment of the invention.

In some embodiments of the invention which include a first waste receptacle or second waste receptacle which configured to contain a plurality of received dies, the first waste receptacle or second waste receptacle may support said plurality of received dies next to one another in the same order to that in which the dies are received. In more detail, by way of example, FIG. 7 shows a second waste receptacle 78 located at the end of first and second waste conduits 74, 76. In use, as discussed above if a die is removed from the rivet setter and passes to a disposal target in the form of first waste conduit 74, the die will pass through the first waste conduit 74, through the second waste conduit 76 and into the second waste receptacle 78. In the shown embodiment the diameter of the second waste receptacle 78 is only slightly greater than the diameter of the dies received by the second waste receptacle. In this way the second waste receptacle 78 supports said plurality of received dies next to one another in the same order to that in which the dies are received. That is to say die 30*a* was received first die 30*b*, which is next to die 30*a*, was received second; and the space 30*c* next to die 30*b* will be occupied by die 30 once it is released.

It may be beneficial for the waste receptacle 78 to support the received dies in the order they are received, because this enables post-analysis of the dies based on the chronology of when each die was removed from the rivet setter. In the shown embodiment the manner in which the second waste receptacle 78 supports said plurality of received dies next to one another in the same order to that in which the dies are received is due to the diameter of the second waste receptacle 78 being only slightly greater than the diameter of the dies received by the second waste receptacle. However, it will be appreciated that in other embodiments any appropriate arrangement which supports said plurality of received dies next to one another in the same order to that in which the dies are received may be used.

It will be appreciated that any number of modifications to the embodiments discussed above may be made without departing from the scope of the invention as defined by the claims.

One such modification relates to the first die support. In the described embodiments the first die support is a carousel, the first and second die supporting portions are angularly spaced and the movement of the first die support is rotation about an axis. In other embodiments this need not be the case—the first die support may have any appropriate shape—for example, linear or rectangular. In these examples the first and second die supporting portions are not angularly spaced and the movement of the first die support will be a translation.

The invention claimed is:

1. A die changing apparatus comprising:

a first die support for supporting a plurality of dies, the first die support having first and second die supporting portions which are spaced from one another, the die support being movable so that either the first die supporting portion or the second die supporting portion are locatable at a first transfer position;

a transfer arrangement comprising a first grip portion configured to grip a die from one of the first and second die supporting portions when said one of the first and second die supporting portions is located at the first transfer position, and thereby remove said gripped die from the first die support;

the transfer arrangement being movable, independently of the first die support, between a first configuration in which the first grip portion can grip said die from said one of the first and second die supporting portions when said one of the first and second die supporting portions is located at the first transfer position, and a second configuration in which the first grip portion can release said die and pass it to a second die support of a rivet setter located at a second transfer position; and wherein the transfer arrangement comprises a second grip portion, and wherein in the first configuration of the transfer arrangement the second grip portion is configured to grip a second die from the second die support of the rivet setter located at the second transfer position, wherein the first grip portion is configured to grip the die from one of the first and second die supporting portions when said one of the first and second die supporting portions is located at the first transfer position at the same time that the second grip portion is configured to grip the second die from the second die support of the rivet setter located at the second transfer position, and wherein in the second configuration of the transfer arrangement the second grip portion can release said second die and pass it to a disposal target.

2. The die changing apparatus according to claim 1, wherein the first die support is a carousel which is rotatable about a first axis, the first and second die supporting portions being angularly spaced from one another about the first axis, the first die support being rotatable so that either the first die supporting portion or the second die supporting portion are locatable at a first transfer position.

3. The die changing apparatus according to claim 1, wherein the disposal target forms part of the first die support.

4. The die changing apparatus according to claim 3, wherein the disposal target is one of: the first die supporting portion, the second die supporting portion or a third die supporting portion.

5. The die changing apparatus according to claim 3, wherein the disposal target of the first die support is a waste receptacle or conduit.

6. The die changing apparatus according to claim 3, wherein a portion of the die changing apparatus is configured to be located within a restricted area, into which entry by personnel is restricted, such that the first transfer position is located in the restricted area; and wherein a portion of the first die support is locatable outside the restricted area, said portion of the first die support comprising the disposal target or the waste receptacle.

7. The die changing apparatus according to claim 5, wherein the first die support comprises a waste conduit, the waste conduit having a first end connected to the first die support and a second end spaced from the first end, the die changing apparatus being configured whereby when the first die support is located such that the waste conduit is located at the first transfer position, the second end of the waste conduit is located adjacent a second waste receptacle or conduit, such that if said second die is passed to the waste conduit, the second die may pass through the waste conduit from the first end to the second end, and then into the second waste receptacle or conduit.

8. The die changing apparatus according to claim 5, wherein the waste receptacle is configured to contain a plurality of received dies, whereby the waste receptacle supports said plurality of received dies next to one another in the same order to that in which the dies are received.

9. The die changing apparatus according to claim 7, wherein a portion of the die changing apparatus is configured to be located within a restricted area, into which entry by personnel is restricted, and wherein the die changing apparatus comprises a second waste conduit; wherein the first transfer position is located in the restricted area and the second waste conduit comprises third and fourth spaced ends, the third end being located adjacent the waste conduit when the second end of the waste conduit is located adjacent the second waste conduit, and the fourth end being located outside of the restricted area.

10. The die changing apparatus according to claim 7, wherein the second waste receptacle is configured to contain a plurality of received dies, whereby the second waste receptacle supports said plurality of received dies next to one another in the same order to that in which the dies are received.

11. The die changing apparatus according to claim 1, wherein the first die support comprises a waste receptacle or conduit and wherein the transfer arrangement is configured to remove a second die from the second die support of a rivet setter and pass it to the waste receptacle or conduit when the waste receptacle or conduit is located at the first transfer position.

12. The die changing apparatus according to claim 1, wherein a portion of the die changing apparatus is configured to be located within a restricted area, into which entry by personnel is restricted, such that the first transfer position is located in the restricted area; and wherein a portion of the first die support is locatable outside the restricted area, said portion of the first die support comprising the first and/or second die supporting portion.

13. The die changing apparatus according to claim 1, wherein each of the first die supporting portion and the second die supporting portion are configured to support a plurality dies, the first die supporting portion configured to support a plurality of dies of a first type and the second die supporting portion being configured to support a plurality of dies of a second type.

14. A method of changing a die using a die changing apparatus, the die changing apparatus comprising:

a first die support, the first die support having first and second die supporting portions which are spaced from one another, and a transfer arrangement comprising a first grip portion, the method comprising:

supporting a plurality of dies on the first die support, moving the first die support so that either the first die supporting portion or the second die supporting portion are located at a first transfer position;

the first grip portion gripping a die from one of the first and second die supporting portions when said one of the first and second die supporting portions is located at the first transfer position, and the transfer arrangement thereby removing said gripped die from the first die support;

moving the transfer arrangement, independently of the first die support, between a first configuration in which said gripping can occur, and a second configuration in which the first grip portion releases said die and passes said die to a second die support of a rivet setter located at a second transfer position; and wherein the transfer arrangement comprises a second grip portion, and wherein in the first configuration of the transfer arrangement the second grip portion grips a second die from the second die support of a rivet setter located at the second transfer position at the same time that the first grip portion grips the die from one of the first and second die supporting portions when said one of the first and second die supporting portions is located at the first transfer position, and wherein in the second configuration of the transfer arrangement the second grip portion releases said second die and passes it to a disposal target.

15. The method according to claim 14, wherein the first die support is a carousel which is rotatable about a first axis, the first and second die supporting portions being angularly spaced from one another about the first axis, and wherein said moving the first die support so that either the first die supporting portion or the second die supporting portion are located at the first transfer position comprises the first die support being rotated so that either the first die supporting portion or the second die supporting portion are at the first transfer position.

16. The method according to claim 14, wherein the disposal target forms part of the first die support.

17. The method according to claim 16, wherein the disposal target is one of: the first die supporting portion, the second die supporting portion or a third die supporting portion.

18. The method according to claim 16, wherein the disposal target of the first die support is a waste receptacle or conduit.

19. The method according to claim 16, wherein a portion of the die changing apparatus is located within a restricted area, into which entry by personnel is restricted, such that the first transfer position is located in the restricted area; the method comprising locating a portion of the first die support outside the restricted area, said portion of the first die support comprising the disposal target or the waste receptacle.

20. The method according to claim 18, wherein the waste receptacle receives a plurality of dies; the method further comprising:

the waste receptacle supporting said plurality of received dies next to one another in the same order to that in which the dies are received.

21. The method according to claim 18, wherein the first die support comprises a waste conduit, the waste conduit having a first end connected to the first die support and a second end spaced from the first end, the method further comprising:

locating the first die support such that the waste conduit is located at the first transfer position, locating the second end of the waste conduit adjacent a second waste receptacle or conduit, passing the second die to the waste conduit, such that the second die passes through the waste conduit from the first end to the second end, and then into the second waste receptacle or conduit.

22. The method according to claim 21, wherein the second waste receptacle receives a plurality of dies; the method further comprising:

the second waste receptacle supporting said plurality of received dies next to one another in the same order to that in which the dies are received.

23. The method according to claim 21, wherein a portion of the die changing apparatus is located within a restricted area, into which entry by personnel is restricted, and wherein the die changing apparatus comprises a second waste conduit; wherein the first transfer position is located in the restricted area and the second waste conduit comprises third and fourth spaced ends; the method further comprising:

locating the third end adjacent the waste conduit when the second end of the waste conduit is located adjacent the second waste conduit; and locating the fourth end outside of the restricted area.

24. The method according to claim 14, wherein the first die support comprises a waste receptacle or conduit and wherein the method further comprises:

the transfer arrangement removing a second die from the second die support of a rivet setter and passing it to the waste receptacle or conduit when the waste receptacle or conduit is located at the first transfer position.

25. The method according to claim 14, wherein a portion of the die changing apparatus is located within a restricted area, into which entry by personnel is restricted, such that the first transfer position is located in the restricted area; wherein the method further comprises locating a portion of the first die support outside the restricted area, said portion of the first die support comprising the first and/or second die supporting portion.

26. The method according to claim 14, wherein each of the first die supporting portion and the second die supporting portion support a plurality dies, the first die supporting portion supporting a plurality of dies of a first type and the second die supporting portion supporting a plurality of dies of a second type.

27. A method of manufacturing a product, the method comprising:

fastening together two or more layers of a material using a rivet setter in combination with a die changing apparatus, supporting a plurality of dies on a first die support and a second die support of the rivet setter, moving the first die support so that either a first die supporting portion or a second die supporting portion of the first die support are located at a first transfer position;

a first grip portion of a transfer arrangement gripping a die from one of the first and second die supporting portions when said one of the first and second die supporting portions is located at the first transfer position, and a second grip portion of the transfer arrangement gripping a second die from a second die support located at the second transfer position at the same time that the first grip portion grips the die from one of the first and second die supporting portions, the transfer arrangement thereby removing said gripped die from the first die support and said gripped second die from the second die support; and moving the transfer arrangement, independently of the first and second die supports, between a first configuration in which said gripping can occur, and a second configuration in which the first grip portion releases said die and passes said die to the second die support located at the second transfer position and the second grip portion releases said second die and passes it to a disposal target.

28. A method according to claim 27 wherein the product is a portion of a vehicle.

* * * * *